US011767736B2

(12) United States Patent
Takahashi

(10) Patent No.: US 11,767,736 B2
(45) Date of Patent: Sep. 26, 2023

(54) DART FOR DOWNHOLE DEVICE AND DOWNHOLE DEVICE

(71) Applicant: Kureha Corporation, Tokyo (JP)

(72) Inventor: Shinya Takahashi, Tokyo (JP)

(73) Assignee: KUREHA CORPORATION, Tokyo (JP)

( * ) Notice: Subject to any disclaimer, the term of this patent is extended or adjusted under 35 U.S.C. 154(b) by 0 days.

(21) Appl. No.: 18/006,986

(22) PCT Filed: Jul. 9, 2021

(86) PCT No.: PCT/JP2021/025879

§ 371 (c)(1),
(2) Date: Jan. 26, 2023

(87) PCT Pub. No.: WO2022/024711

PCT Pub. Date: Feb. 3, 2022

(65) Prior Publication Data

US 2023/0212926 A1 Jul. 6, 2023

(30) Foreign Application Priority Data

Jul. 31, 2020 (JP) ..... 2020-130685

(51) Int. Cl.

| | |
|---|---|
| ***E21B 34/14*** | (2006.01) |
| ***E21B 29/00*** | (2006.01) |
| ***E21B 43/14*** | (2006.01) |
| ***E21B 43/26*** | (2006.01) |

(52) U.S. Cl.
CPC ..... *E21B 34/142* (2020.05); *E21B 43/14* (2013.01); *E21B 43/26* (2013.01)

(58) Field of Classification Search
CPC ..... E21B 34/142; E21B 29/00
See application file for complete search history.

(56) References Cited

U.S. PATENT DOCUMENTS

| | | | | |
|---|---|---|---|---|
| 9,777,553 | B2 * | 10/2017 | Silva | E21B 34/142 |
| 9,879,500 | B2 | 1/2018 | Okura et al. | |
| 9,951,596 | B2 | 4/2018 | Lynk | |
| 10,801,304 | B2 | 10/2020 | Hughes et al. | |
| 11,280,160 | B2 * | 3/2022 | Calahan | E21B 34/142 |
| 2016/0108711 | A1 | 4/2016 | Lynk | |
| 2017/0015900 | A1 | 1/2017 | Okura et al. | |
| 2020/0095855 | A1 | 3/2020 | Hughes et al. | |
| 2022/0112794 | A1 * | 4/2022 | Gibson | E21B 43/14 |

FOREIGN PATENT DOCUMENTS

| | | | |
|---|---|---|---|
| WO | 2015/133543 | A1 | 9/2015 |
| WO | 2020/087089 | A1 | 4/2020 |

OTHER PUBLICATIONS

International Preliminary Report on Patentability and Written Opinion of the International Searching Authority dated Jan. 31, 2023, in PCT Application No. PCT/JP2021/025879.

* cited by examiner

*Primary Examiner* — Kenneth L Thompson
(74) *Attorney, Agent, or Firm* — Birch, Stewart, Kolasch & Birch, LLP

(57) ABSTRACT

In a dart for a downhole device according to the present invention, a ball is formed of a first degradable material having a first degradation rate, a mandrel is formed of a second degradable material having a second degradation rate lower than the first degradation rate, and a sleeve is formed of the second degradable material or a third degradable material having a third degradation rate lower than the second degradation rate.

4 Claims, 1 Drawing Sheet

[FIG. 1]
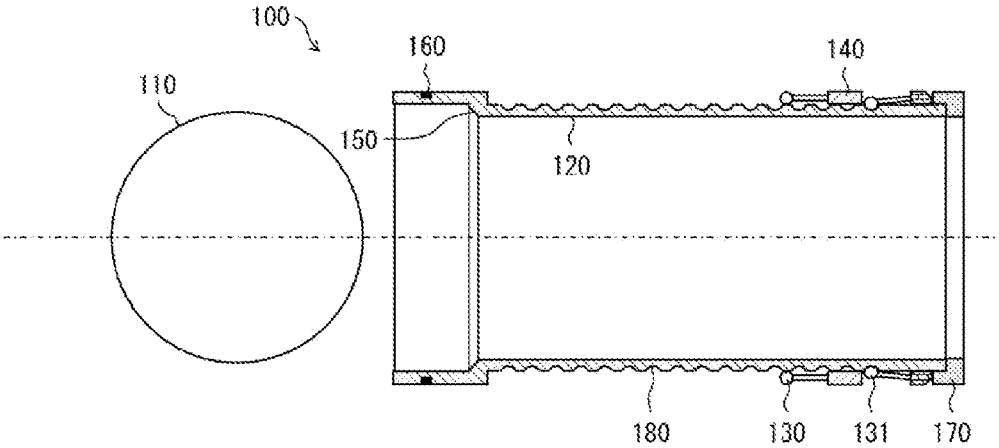
[FIG. 2]
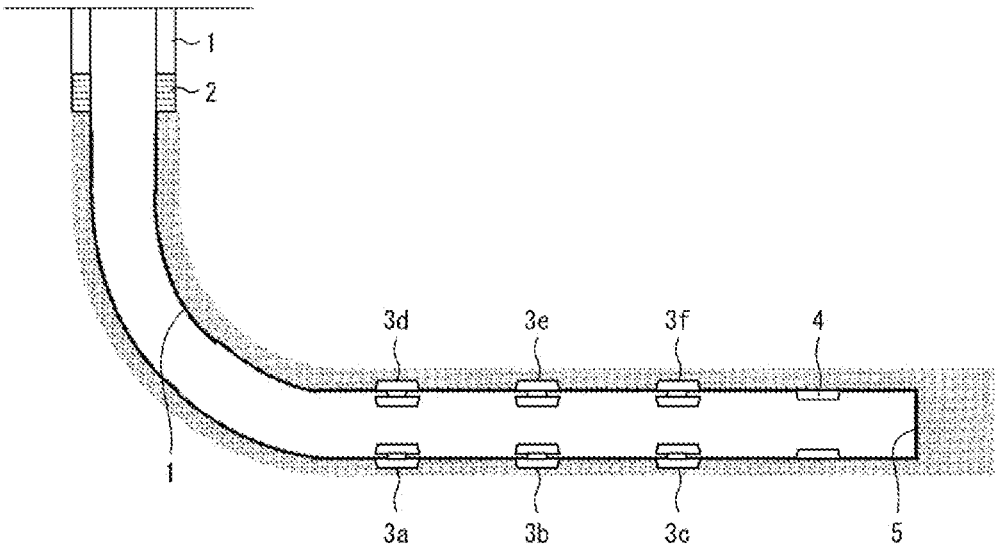

DART FOR DOWNHOLE DEVICE AND DOWNHOLE DEVICE

TECHNICAL FIELD

The present invention relates to a dart for a downhole device and a downhole device.

BACKGROUND ART

Hydrocarbon resources such as petroleum (including shale oil) and natural gas (including shale gas) have been produced by extraction through wells (oil well or gas well, sometimes referred to collectively as "well") having a porous and permeable subterranean formation.

In wells that are continuously extracted, a production reservoir is stimulated in order to continuously extract hydrocarbon resources efficiently from subterranean formations of which permeability has decreased over time or subterranean formations of which permeability is originally insufficient. Examples of the stimulation method include acid treatment and fracturing method. As a fracturing method, a hydraulic fracturing method (also referred to as "fracturing") for forming cracks (fractures) has attracted attention.

The hydraulic fracturing method is a method for generating perforations or cracks in a production reservoir by a fluid pressure such as hydraulic pressure (hereinafter, sometimes simply referred to as "hydraulic pressure"). Generally, a vertical hole is drilled, subsequently, the vertical hole is bent to drill a horizontal hole in a subterranean formation several thousand meters underground, and then a fluid such as a fracturing fluid is introduced into these wellbores (which mean holes provided for forming a well, sometimes referred to as a "downhole") at a high pressure. Then, fractures or the like are caused by hydraulic pressure in a production reservoir under deep subterranean (a layer in which hydrocarbon resources such as petroleum and natural gas are produced), and hydrocarbon resources are collected and recovered through the fractures or the like. The efficacy of hydraulic fracturing method has also been examined for the development of unconventional resources such as shale oil (oil that matures in shale) and shale gas.

A downhole device used for well drilling is subjected to extremely high forces (such as a tensile force, a compressive force, and a shear force) during a well treatment operation, such as, for example, fracturing. Thus, the downhole device requires strength to withstand such forces. On the other hand, members used in the downhole device need to be rapidly removed in a certain manner after well treatment.

For example, Patent Document 1 discloses a smart dart system (downhole device) which is a multistage hydraulic fracturing system. In this system, after embedding a casing incorporating a specific structure at a constant interval, a dart composed of a mandrel, a collet, and a ball is introduced from the ground surface and fix them at a specific structure position, and hydraulic fracturing is performed. A phenol resin, iron, aluminum, and a degradable composite are disclosed in Patent Document 1 as materials constituting the system.

CITATION LIST

Patent Document

Patent Document 1: WO 2020/087089

SUMMARY OF INVENTION

Technical Problem

In order to allow a large amount of fluid to flow through the inner hole of the mandrel constituting the dart, the thicknesses of the mandrel and the collet are reduced. As a result, when the dart is formed of a degradable material, there is a problem that the dart is degraded before the application of hydraulic pressure, and the movement to a frac valve and installation of the dart within the well is difficult to control. Furthermore, due to insufficient strength resulting from degradation, there is a problem that the dart is destroyed, and the hydraulic pressure resistance performance of the downhole device is reduced.

An object of one aspect of the present invention is to provide a dart for a downhole device in which movement and installation to a frac valve in a well are easily controlled even if the dart is formed of a degradable material.

Solution to Problem

In order to solve the above problem, a dart for a downhole device according to an aspect of the present invention includes a ball, a cylindrical mandrel having a ball seat on which the ball is seated, and a sleeve attached to an outer periphery of the mandrel, wherein the mandrel has a plurality of circumferential grooves on the outer periphery, the sleeve includes an upper collet and a lower collet that are inclined radially inwardly of the mandrel, one of the upper collet or the lower collet engages the groove of the mandrel by reducing a diameter, and the other is in contact with a part between the grooves of the mandrel by increasing the diameter, the ball is formed of a first degradable material having a first degradation rate, the mandrel is formed of the first degradable material or a second degradable material having a second degradation rate that is less than the first degradation rate, and the sleeve is formed of the second degradable material or a third degradable material having a third degradation rate that is less than the second degradation rate.

In addition, a dart for a downhole device according to an aspect of the present invention includes a ball, a cylindrical mandrel having a ball seat on which the ball is seated, and a sleeve attached to an outer periphery of the mandrel, wherein the mandrel has a plurality of circumferential grooves on the outer periphery, the sleeve includes an upper collet and a lower collet that are inclined radially inwardly of the mandrel, one of the upper collet or the lower collet engages the groove of the mandrel by reducing a diameter, and the other is in contact with a part between the grooves of the mandrel by increasing the diameter, the sleeve, the mandrel, and the ball are each formed of a degradable material, and the sleeve and the mandrel have a lead time for degradation.

Advantageous Effects of Invention

According to an aspect of the present invention, it is possible to provide a dart for a downhole device of which movement to a frac valve and installation in a well are easily controlled even if the dart is formed of a degradable material.

BRIEF DESCRIPTION OF THE DRAWINGS

FIG. 1 is a cross-sectional view of a dart for a downhole device according to the present embodiment.

FIG. 2 is a cross-sectional view of a liner of a downhole device according to the present embodiment.

DESCRIPTION OF EMBODIMENTS

[Dart 100 for Downhole Device]

Hereinafter, a dart for a downhole device according to the present embodiment (hereinafter, which may be abbreviated as "dart of the present embodiment") will be described in detail with reference to FIG. 1. FIG. 1 is a cross-sectional view of a dart 100 according to the present embodiment. The dart 100 opens an opening mechanism of a frac valve of a downhole device. An example of a configuration of the dart according to the present embodiment is described in Patent Document 1.

In the present specification, the downhole device means a device used in a well for drilling or hydraulic fracturing of the well. An example of the configuration of the downhole device will be described later.

The dart 100 includes a ball 110, a mandrel 120, and a sleeve 140.

(Ball 110)

The ball 110 is a member for blocking a wellbore. The ball 110 can block the wellbore by being seated on a ball seat 150 of the mandrel 120 of the dart 100.

(Mandrel 120)

The mandrel 120 is a hollow cylindrical member that basically ensures the strength of a downhole plug of the downhole device. The diameter of the cross-section of the mandrel 120 is appropriately selected according to the size of the wellbore.

The ball seat 150 on which the ball 110 is seated is provided at an upper end of an outer peripheral surface of the mandrel 120. A plurality of grooves 180 are provided on the outer peripheral surface of the mandrel 120 along a circumferential direction. Since the plurality of grooves 180 are provided, an initial position and an axial movement amount of the sleeve 140 can be adjusted. The mandrel 120 may change in a diameter along the axial direction. Further, the mandrel 120 may have a fixing portion, a step portion, a concave portion, a convex portion, and the like on an outer surface thereof.

A seal 160 is provided at the upper end of the outer peripheral surface of the mandrel 120. The seal 160 functions as a secondary seal device during fracturing.

(Sleeve 140)

The sleeve 140 is mounted on the outer peripheral surface of the mandrel 120. The sleeve 140 includes an upper collet 130 and a lower collet 131 that are inclined radially inwardly of the mandrel 120. The upper collet 130 is provided on the upper end side of the outer peripheral surface of the mandrel 120 than the lower collet 131. The sleeve 140, together with the mandrel 120 and a cap 170, serves as an adjustment mechanism for engaging the dart 100 at any frac valve position in a liner. The cap 170 prevents unintended movement of the sleeve 140.

One of the upper collet 130 or the lower collet 131 engages the groove 180 of the mandrel 120 by reducing its diameter. The other is in contact with a part between the adjacent grooves 180 of the mandrel 120 by increasing the diameter.

(Material of Member Constituting Dart 100)

The material of the ball 110 is formed of a first degradable material having a first degradation rate.

The material of the mandrel 120 is formed of a second degradable material having a second degradation rate. The second degradation rate is less than the first degradation rate.

The material of the sleeve 140 is formed of a second degradable material or a third degradable material having a third degradation rate. The third degradation rate is less than the first degradation rate and the second degradation rate.

The first to third degradable materials degrade depending on the well environment. As the first to third degradable materials, the degradable material having biodegradability, the degradable material having hydrolyzability, additionally a degradable material that can be chemically degraded by any other method, and a degradable material that can be embrittled and easily disintegrated are usable.

In the present specification, the degradation rate refers to a reduction rate of thickness of the member formed of the degradable material in a 0.05% potassium chloride aqueous solution at 66° C. (hereinafter, sometimes abbreviated as "thickness reduction rate"). The degradation rate can be confirmed by the reduction rate of thickness when a cubic test piece having a side of 10 mm is immersed in a 0.05% potassium chloride aqueous solution at 66° C.

Specifically, the thickness reduction rate can be measured according to the following method. That is, a required number of cubic test pieces having a side of 10 mm are prepared by cutting a stock shape molded by solid-state extrusion molding, injection molding, plastic working, forging, casting, or extrusion. Next, the test piece is placed in a 1 L-autoclave at a temperature of 66° C. or in a glass container equipped with a lid, filled with a 0.05% potassium chloride aqueous solution, and subjected to an immersion test. The test piece after immersion at a predetermined time period is removed, and the surface is wiped with a brush or the like to remove a degradation by-product or low molecular weight substance attached to the surface. After removal, the thickness of a core (hard part) of the test piece is measured, and the reduced thickness of the test piece is measured from the difference from the thickness before immersion (initial thickness, specifically 10 mm). The change of the reduced thickness of the test piece over time is determined based on the measured value of the reduced thickness of the test piece measured for different immersion time periods. Then, the thickness reduction rate (unit: mm/hr) of the test piece having a thickness of 10 mm is calculated from the time variation for the thickness reduction of the test piece in a range where the thickness reduction of the test piece has linear variation over time.

The thickness reduction rate of the ball 110 is preferably 0.1 or greater, more preferably 0.4 or greater, and particularly preferably 0.7 or greater. The thickness reduction rate of the ball 110 is preferably 1.5 or less, more preferably 1.0 or less, and still more preferably 0.8 or less. The thickness reduction rate of the mandrel 120 is preferably 0.04 or greater, more preferably 0.1 or greater, and still more preferably 0.2 or greater. Furthermore, the thickness reduction rate of the mandrel 120 is preferably 0.7 or less, and more preferably 0.4 or less. The thickness reduction rate of the sleeve 140 is preferably 0.04 or greater, and more preferably 0.1 or greater. The thickness reduction rate of the sleeve 140 is preferably 0.4 or less, more preferably 0.3 or less, and still more preferably 0.15 or less.

Among the ball 110, the mandrel 120, and the sleeve 140, the material forming the ball 110 has the highest degradation rate. In addition, the degradation rates of the material forming the mandrel 120 and the material forming the sleeve 140 are the same, or the degradation rate of the material forming the mandrel 120 is greater. In such a configuration, their movement to a frac valve and installation in a well are easily controlled even if they are formed of a degradable material. Thus, the downhole device including the dart 100 has high hydraulic pressure resistance performance. In terms of control of movement to the frac valve and installation in the well, the degradation rate of the material forming the mandrel 120 is preferably greater than the degradation rate of the material forming the sleeve 140.

Examples of the first to third degradable materials include a degradable resin and a degradable metal. Examples of the degradable resin include aliphatic polyesters, aliphatic polyamides, aliphatic polyurethanes, and aliphatic polyvinyl alcohols. Examples of the degradable metal include magnesium (Mg), aluminum (Al), and calcium (Ca). Examples of the degradable metal include an alloy of magnesium and another metal (Mg alloy), an alloy of aluminum and another metal (Al alloy), and an alloy of calcium and another metal (Ca alloy). The degradable material is preferably a degradable resin, and is preferably aliphatic polyester, from the viewpoint that the degradation rate is not affected by the salt concentration in the environment. The degradable resin may be one type alone or a combination obtained by mixing two or more types. In addition, a degradable metal is preferable in that it has high spreadability and further has a desired strength in a high-temperature and high-pressure environment under deep subterranean. Since the metal material has lower temperature dependency of mechanical strength than that of the resin material, deformation and breakage due to a high-temperature environment of the well are less likely to occur, and the metal material easily exhibits designed hydraulic pressure resistance performance as a downhole dart. Furthermore, since the degradable material is degraded, dissolved or easily fragmented in a well environment, after the use of the downhole dart, there is a little risk to block the well at reflux during hydrocarbon resource recovery, and damage the recovery facility in the ground surface and the well. Therefore, it is preferable that any of the first to third degradable materials is a degradable metal that has both advantages of the metal material and the degradable material. The degradable metal is preferably an Mg alloy in that high tensile strength and desired degradation rate are obtained.

Examples of the aliphatic polyesters include aliphatic esters of hydroxycarboxylic acid such as polyglycolic acid (PGA) and polylactic acid (PLA); aliphatic polyesters of lactone such as poly-ε-caprolactone (PCL); diol dicarboxylic acid aliphatic esters such as polyethylene succinate and polybutylene succinate; copolymers thereof; and mixtures thereof. In addition, aliphatic polyester using an aromatic component such as polyethylene adipate/terephthalate in combination is also an example of the aliphatic polyester.

Examples of the Mg alloy include Mg alloys containing Y, Gd, Cu, Zn, and Ni as a first additive element group and other unavoidable impurities. The high tensile strength can be obtained by adding the first additive element group of Y and Gd. In addition, by adding the first additive element group of Cu and Ni, a degradation promoting effect can be obtained, and in particular, Cu can provide high tensile strength. Furthermore, by adding the first additive element group of Zn, high tensile strength is obtained, and a degradation suppressing effect is obtained. By adjusting the addition amounts of these elements of the first additive element group, a Mg alloy having desired strength and a desired thickness reduction rate is obtained.

Examples of the Mg alloy include a Mg alloy containing a first additive element group including 0.1 to 2 mass % of Y, 3 to 7 mass % of Gd, 0.1 to 2 mass % of Cu, 0.1 to 2 mass % of Zn, and 1 to 7 mass % of Ni as essential additive elements and containing other unavoidable impurities.

From the viewpoint of achieving both the high tensile strength and the degradation rate, the Mg alloy more preferably includes 0.3 to 1 mass % of Y, 3.5 to 6 mass % of Gd, 0.3 to 1 mass % of Zn, 0.4 to 1.5 mass % of Cu, and 1.5 to 6 mass % Ni, and the total amount of the first additive element group added is more preferably 7 to 15 mass %. With such a composition of the degradable metal, a degradable metal having a thickness reduction rate of 0.40 or greater and 1.15 or less, preferably 0.45 or greater and 1.15 or less can be obtained and suitably used as the first degradable material.

Further, other examples of the Mg alloy include a Mg alloy containing Al, Cu, and Zn as a first additive element group and other unavoidable impurities. With addition of the first additive element group of Al and Zn, high tensile strength and a degradation suppressing effect are obtained. In addition, with addition of the first additive element group of Cu, a degradation promoting effect and high tensile strength can be obtained.

Examples of the Mg alloy include a Mg alloy containing a first additive element group including 7 to 14 mass % of Al, 8 to 15 mass % of Cu, and 0.01 to 0.3 mass % of Zn as essential additive elements and containing other unavoidable impurities.

From the viewpoint of achieving both the high tensile strength and the degradation rate, the Mg alloy more preferably includes 8 to 13 mass % of Al, 9 to 13 mass % of Cu, 0.08 to 0.15 mass % of Zn, and the total amount of the first additive element group added is more preferably 20 to 25 mass %. With such a composition of the degradable metal, a degradable metal having a thickness reduction rate of 0.15 or greater and less than 0.40 and preferably 0.17 or greater and 0.37 or less can be obtained and suitably used as the second degradable material.

Further, still other examples of the Mg alloy include a Mg alloy containing Al, Mn, Ni and Zn as a first additive element group and other unavoidable impurities. With addition of the first additive element group of Al and Zn, high tensile strength and a degradation suppressing effect are obtained. In addition, with addition of the first additive element group of Ni, a degradation promoting effect is obtained. With addition of the first additive element group of Mn, a degradation suppressing effect can be obtained.

Examples of the Mg alloy include a Mg alloy containing a first additive element group including 7 to 12 mass % of Al, 0.05 to 0.5 mass % of Mn, 0.05 to 1 mass % of Ni, and 0.3 to 2 mass % of Zn as essential additive elements and containing other unavoidable impurities.

From the viewpoint of achieving both the high tensile strength and the degradation rate, the Mg alloy more preferably includes 8 to 10 mass % of Al, 0.1 to 0.3 mass % of Mn, 0.1 to 0.5 mass % of Ni, 0.5 to 1.5 mass % of Zn, and the total amount of the first additive element group added is more preferably 9 to 11 mass %. With such a composition of the degradable metal, a degradable metal having a thickness reduction rate of 0.05 or greater and less than 0.15 and preferably 0.05 or greater and 0.11 or less can be obtained and suitably used as the third degradable material.

The degradation rates of the first to third degradable materials can be optionally adjusted by a predetermined treatment in addition to the selection of the material having a desired degradation rate. When the degradable material is a degradable resin, the degradation rate can be increased by, for example, reducing the molecular weight of the degradable material, adjusting the copolymer ratio of the degradable material to increase the ratio of low-strength components, reducing the degree of crystallinity of the degradable material, or adding a degradation accelerator (for example, a hydrolysis auxiliary agent) to the degradable material. Furthermore, the degradation rate can be reduced by, for example, adding a degradation inhibitor (for example, a hydrolysis inhibitor) to the degradable material or adding a reinforcing material to the degradable material (for example, inorganic short fiber reinforcing material and organic short fiber reinforcing material). When the degradable material is a degradable metal, the degradation rate can be increased by, for example, adding a metal or a metal compound having a cathode potential in a matrix metal of the degradable material to precipitate it, and further dispersing the metal or metal compound precipitate into a fine particle form. Furthermore, the degradation rate can be reduced by, for example, reducing the content of the metal or metal compound having a cathode potential, or reducing the amount of impurities in the matrix metal.

As long as the object of the present invention is not impaired, a resin material (another resin if the degradable material is a degradable resin) and various additives such as a stabilizer may be contained in or blended with the degradable material as other compounding ingredients.

The ball 110, the mandrel 120, and the sleeve 140 can be obtained, for example, by molding the respective degradable materials by a known thermoforming method such as injection molding, melt extrusion molding, solid-state extrusion molding, compression molding, plastic working, forging, casting, or extrusion, and stretch molding. After the molding, machining such as cutting and perforation may be performed as necessary.

In addition, instead of preparing the materials of the ball 110, the mandrel 120, and the sleeve 140 as described above, the mandrel 120 and the sleeve 140 may be prepared to have a lead time in degradation. The darts 100 are sequentially arranged in the wellbore until the well is completed. On the other hand, in a stage where production of oil such as shale oil or natural gas such as shale gas is started, it is necessary to remove the darts. By preparing the dart as described above, the dart 100 is stable during movement of the dart 100 in the well environment. Then, the dart 100 engages with the frac valve of the downhole device, and after the completion of the well treatment, the dart 100 can be degraded.

In the present specification, the "lead time" refers to a time required to start a predetermined operation or reaction, and "having a lead time in degradation" refers to "having a time from immersion in a 0.05% potassium chloride aqueous solution at 66° C. to the start of degradation (degradation lead time)".

The degradation lead time can be confirmed in a manner similar to the measurement of the thickness reduction rate. That is, when a cubic test piece having a side of 10 mm is immersed in a 0.05% potassium chloride aqueous solution at a temperature of 66° C., the degradation lead time can be confirmed by measuring the time until the thickness starts to be reduced.

From the viewpoint that each function can be exerted with high accuracy but without being degraded during the placement process in the well, and that the durability against high hydraulic pressure resulting from hydraulic fracturing after placement is ensured, the degradation lead time of the mandrel 120 and the sleeve 140 is preferably 1 hour or longer, more preferably 4 hours or longer, and even more preferably 8 hours or longer. In addition, the degradation lead time of the mandrel 120 and the sleeve 140 is preferably 14 hours or less, more preferably 12 hours or less, and still more preferably 10 hours or less from the viewpoint of rapidly eliminating the blockage of the well by degradation after completion of the well treatment.

The degradation lead time of the mandrel 120 and the sleeve 140 may be the same as, or may be different from each other. From the viewpoint of rapidly eliminating the blockage of the well by degradation of the dart 100 after completion of the well treatment, the degradation lead time of the mandrel 120 is preferably shorter than the degradation lead time of the sleeve 140.

Among the ball 110, the mandrel 120, and the sleeve 140 which are formed of the first to third degradable materials, for example, the mandrel 120 and the sleeve 140 can be provided with a non-degradable coating to obtain the mandrel 120 and the sleeve 140 having a degradation lead time. In addition, when the mandrel 120 and the sleeve 140 are provided with the non-degradable coating, since the mandrel 120 and the sleeve 140 have a lead time in degradation due to the non-degradable coating, the ball 110 and the mandrel 120 and/or the sleeve 140 can be formed of the same degradable material. With the members formed of the same degradable material, it is possible to suppress defects caused by a difference in physical properties of the degradable materials such as hardness and specific gravity (unintended damage due to collision, installation failure, and the like).

By applying a non-degradable coating to the mandrel 120 and the sleeve 140, it is possible to greatly decrease the contact area between the base material surface of the member and the fluid capable of degrading the first to third degradable materials, for example, in the well. By decreasing the contact area, it is possible to delay the time to the start of degradation of the mandrel 120 and the sleeve 140.

In the present specification, "non-degradable" means that degradation, dissolution, or corrosion does not occur, or the degradation rate is significantly slow when the member is resting in the well environment. That is, "non-degradable" means that the thickness reduction when a cubic test piece having a side of 10 mm is allowed to stand in a 0.05% potassium chloride aqueous solution at 66° C. for 2 days is 0.1 mm or less. When the base materials of the mandrel 120 and the sleeve 140 are a degradable metal, the non-degradable coating can be formed on the mandrel 120 and the sleeve 140 by, for example, anodization, cermet treatment, ceramic treatment, thermal spraying of a metal material, immersion in a molten resin or a solution in which a resin is dissolved, spraying and baking of a resin material, coating of paint or the like. When the base materials of the mandrel 120 and the sleeve 140 are a degradable resin, the non-degradable coating can be formed on the mandrel 120 and the sleeve 140 by, for example, immersion in a molten resin or a solution in which a resin is dissolved, spraying and baking of a resin material, coating of paint or the like. The non-degradable coating may be a coating on a portion of the mandrel 120 or sleeve 140, and may be a coating on the entire mandrel 120 or sleeve 140.

Examples of the resin material used for the non-degradable coating include polyethylene, polytetrafluoroethylene, a copolymer of tetrafluoroethylene and perfluoroalkoxyethylene, polyetheretherketone, and polyimide. Polytetrafluoroethylene is preferable as the resin material of the non-degradable coating from the viewpoint of the uniformity of the coating and the ability to thin a coating layer. It is preferable that the coating is uniform in that a defect site as a degradation start site is hardly generated and a desired lead time is obtained. In addition, it is preferable that the coating layer is thin in that unintended movement and engagement of the member constituting the dart are less likely to occur.

The layer of the non-degradable coating formed by the cermet treatment, the ceramic treatment, or the thermal spraying of the metal material is a laminate of particles and has pores, and thus is preferably treated with a sealing agent. By performing the sealing treatment, the number of pores directly communicating the non-degradable coating surface with the base material surface can be reduced, and the desired lead time can be obtained. Examples of the sealing agent include an epoxy-based resin, a phenol-based resin, a silicone-based resin, and a paraffin.

The ball 110 may also have a degradation lead time. From the viewpoint of rapidly eliminating the blockage of the well by degradation of the dart 100 after completion of the well treatment, the degradation lead time of the ball 110 is preferably shorter than the degradation lead time of the mandrel 120 and the sleeve 140.

[Downhole Device]

Hereinafter, a downhole device according to the present embodiment (hereinafter, which may be abbreviated as "device of the present embodiment") will be described in detail. The device of the present embodiment stimulates one or more stages (production reservoirs) of the well.

The downhole device includes a liner 1. FIG. 2 is a cross-sectional view of the liner 1 fixed to a wall surface of the well by cement. Although not specifically illustrated, the liner 1 may be fixed to the well by a plurality of packers or the like. An example of the configuration of the liner 1 is described in Patent Document 1.

(Liner 1)

The liner 1 is provided with one or more downhole plugs (packers) 2, one or more frac valves 3 (3*a* to 3*f*), one or more toe valves 4, and a toe end 5.

(Downhole Plug 2)

The downhole plug 2 blocks or fixes the wellbore (downhole).

(Frac Valve 3)

The frac valve 3 is disposed within the liner 1. The frac valve 3 has an opening mechanism that allows the communication of fluid outside and inside the liner 1. The inner surfaces of the frac valves 3 have the same contour.

Also, the downhole device is provided with one or more darts 100. When the plurality of darts 100 are provided in the downhole device, the darts 100 have the same configuration. The dart 100 opens the opening mechanism of the frac valve 3.

SUMMARY

A dart for a downhole device according to the present embodiment includes a ball, a cylindrical mandrel having a ball seat on which the ball is seated, and a sleeve attached to an outer periphery of the mandrel, wherein the mandrel has a plurality of circumferential grooves on the outer periphery, the sleeve includes an upper collet and a lower collet that are inclined radially inwardly of the mandrel, one of the upper collet or the lower collet engages the groove of the mandrel by reducing a diameter, and the other is in contact with a part between the grooves of the mandrel by increasing the diameter, the ball is formed of a first degradable material having a first degradation rate, the mandrel is formed of a second degradable material having a second degradation rate that is less than the first degradation rate, and the sleeve is formed of the second degradable material or a third degradable material having a third degradation rate that is less than the second degradation rate.

In addition, a dart for a downhole device according to the present embodiment includes a ball, a cylindrical mandrel having a ball seat on which the ball is seated, and a sleeve attached to an outer periphery of the mandrel, wherein the mandrel has a plurality of circumferential grooves on the outer periphery, the sleeve includes an upper collet and a lower collet that are inclined radially inwardly of the mandrel, one of the upper collet or the lower collet engages the groove of the mandrel by reducing a diameter, and the other is in contact with a part between the grooves of the mandrel by increasing the diameter, the sleeve, the mandrel, and the ball are each formed of a degradable material, and the sleeve and the mandrel have a lead time for degradation.

In the dart for a downhole device according to the present embodiment, the sleeve and the mandrel may each be formed of a degradable material and have a non-degradable coating.

The downhole device according to the present embodiment is a downhole device for stimulating one or more stages in a well, the downhole device including: one or more frac valves disposed in a liner and each having an opening mechanism that enables communication of fluid inside and outside the liner; and one or more darts for a downhole device for opening the opening mechanism of the frac valve, wherein inner surfaces of the one or more frac valves have the same contours, and the one or more darts are the same as each other.

REFERENCE SIGNS LIST

1 Liner
2 Downhole plug
3 Frac valve
4 Toe valve
5 Toe end
100 Dart
110 Ball
120 Mandrel
130 Upper collet
131 Lower collet
140 Sleeve
150 Ball seat
160 Seal
170 Cap
180 Groove

The invention claimed is:

1. A dart for a downhole device, comprising:

a ball;

a cylindrical mandrel having a ball seat on which the ball is seated; and a sleeve attached to an outer periphery of the mandrel, wherein the mandrel has a plurality of circumferential grooves on the outer periphery, the sleeve includes an upper collet and a lower collet that are inclined radially inwardly of the mandrel, one of the upper collet or the lower collet engages the groove of the mandrel by reducing a diameter, and the other is in contact with a part between the grooves of the mandrel by increasing the diameter, the ball is formed of a first degradable material having a first degradation rate, the mandrel is formed of a second degradable material having a second degradation rate that is less than the first degradation rate, the sleeve is formed of a third degradable material having a third degradation rate that is less than the second degradation rate, and the sleeve serves as an adjustment mechanism for engaging the dart at any frac valve position in a liner.

2. A dart for a downhole device, comprising:

a ball;

a cylindrical mandrel having a ball seat on which the ball is seated; and a sleeve attached to an outer periphery of the mandrel, wherein the mandrel has a plurality of circumferential grooves on the outer periphery, the sleeve includes an upper collet and a lower collet that are inclined radially inwardly of the mandrel, one of the upper collet or the lower collet engages the groove of the mandrel by reducing a diameter, and the other is in contact with a part between the grooves of the mandrel by increasing the diameter, the sleeve, the mandrel, and the ball are each formed of a degradable material, and the sleeve and the mandrel have a lead time for degradation, wherein the sleeve and the mandrel each have a non-degradable coating.

3. A downhole device for stimulating one or more stages in a well, the downhole device comprising:

one or more frac valves disposed in a liner and each having an opening mechanism that enables communication of fluid inside and outside the liner; and one or more darts for a downhole device described in claim 1 for opening the opening mechanism of the frac valve, wherein inner surfaces of the one or more frac valves have the same contours, and the one or more darts are the same as each other.

4. A downhole device for stimulating one or more stages in a well, the downhole device comprising:

one or more frac valves disposed in a liner and each having an opening mechanism that enables communication of fluid inside and outside the liner; and one or more darts for a downhole device described in claim 2 for opening the opening mechanism of the frac valve, wherein inner surfaces of the one or more frac valves have the same contours, and the one or more darts are the same as each other.

* * * * *